United States Patent [19]

Sharp

[11] 4,100,996

[45] Jul. 18, 1978

[54] SHOCK ABSORBER FOR A SAFETY BELT LANYARD

[76] Inventor: Jonathan E. Sharp, 3999 Hillside Pl., Littleton, Colo. 80123

[21] Appl. No.: 803,551

[22] Filed: Jun. 6, 1977

[51] Int. Cl.[2] ..... E06C 7/18; A62B 1/16

[52] U.S. Cl. ..... 182/3; 188/65.4

[58] Field of Search ..... 182/3, 5–8; 188/65.4, 65.5; 297/386

[56] References Cited

U.S. PATENT DOCUMENTS

| | | | |
|---|---|---|---|
| 2,303,954 | 12/1942 | Roke | 182/3 |
| 2,613,865 | 10/1952 | Rose | 182/3 |
| 3,444,957 | 5/1969 | Ervin | 182/3 |

*Primary Examiner*—Reinaldo P. Machado

*Attorney, Agent, or Firm*—Van Valkenburgh and Lowe

[57] ABSTRACT

The present invention is a shock absorber for a safety belt lanyard. It comprises, in essence, a strap-like web of strength sufficient to check a fall, having a short base portion at one end and a free reach constituting the remainder. The end of the base portion connects with the center bar of a three-bar slide and the junction between the base portion and the free reach is a connector loop to connect with a lanyard or safety belt. The free reach, commencing at the loop, has its extended end threaded through the three-bar slide to terminate as a second connector loop opposite the first mentioned connector loop to connect with the safety belt or lanyard. The free reach of the web is folded against the base to provide a compact package which is enclosed in a disruptible cover to complete the unit. In use, the free reach is pulled through the three-bar slide to provide the necessary resistance to decelerate the fall.

6 Claims, 5 Drawing Figures

SHOCK ABSORBER FOR A SAFETY BELT LANYARD

The present invention relates to shock absorbers for safety gear, and more particularly to shock absorbers for safety belt lanyards.

A safety belt, worn by a workman on a scaffold or other perch, is connected to a life line, or lanyard, which in turn is secured to an anchor point in the structure alongside the scaffold. Thus, should the workman fall, or the scaffold collapse, the fall of the workman will be checked. In checking a fall, however, some mode of deceleration must be applied for a sudden stop could seriously injure the workman. Thus, it is a common, and necessary, practice to incorporate a shock absorber into the lanyard and a number of such shock absorbers have been developed for this purpose. A popular type is disclosed in the patent to Ervin, No. 3,444,957, issued May 20, 1969.

In the construction disclosed in that patent, the shock absorber functions by breaking stitches of a web sewn together as the web is pulled apart to thus absorb the kinetic energy of a fall. The stitching pattern is such that breaking commences when a selected maximum pull is applied to the brake. Some disadvantages of the construction reside in the fact that the shock absorber is quite expensive to manufacture and the stitch-breaking is erratic, that is, a number of threads of the stitches bunch up together to break simultaneously with an erratic pull upon the workman wearing the safety belt.

Another type of shock absorber uses undrawn nylon, which is drawn as a fall is decelerated to a stop. This unit is expensive to manufacture and sometimes materials are hard to obtain. In these and other types known, the shock absorbers are good for a single use and once used, they must be discarded.

It follows that there is an ever present need for an improved shock absorber for a safety-belt-lanyard combination which avoids some of the objections of the prior art units. The present invention was conceived and developed with such need in view. The invention, a shock absorber for a lanyard, comprises, in essence, a strap-like web of strength sufficient to check a fall, having a short base portion at one end and a free reach in tandem constituting the remainder. The end of the base portion connects with a three-bar slide and the junction between the base portion and the free reach is a connector loop to connect with a lanyard or safety belt. The free reach, commencing at the loop, has its extended end threaded through the three-bar slide to terminate as a second connector loop opposite the first mentioned connector loop to connect with the safety belt or lanyard. The free reach of the web is folded against the base to provide a compact package which is enclosed in a disruptible cover to complete the unit. In use, the free reach is pulled through the three-bar slide to provide the necessary resistance to decelerate the fall.

It follows that an object of the invention is to provide a novel and improved shock absorber for a safety belt lanyard which is simple, neat, inexpensive and reliable.

Another object of the invention is to provide a novel and improved shock absorber for a safety belt lanyard which does not destroy the web when it is used and in an emergency, can be rethreaded and reused.

Another object of the invention is to provide a novel and improved shock absorber for a safety belt lanyard which applies a braking force in a uniform manner effecting a smooth release by movement of the strap through the three-bar slide.

With the foregoing and other objects in view, my present invention comprises certain constructions, combinations and arrangements of parts and elements as hereinafter described, defined in the appended claims, and illustrated in preferred embodiment by the accompanying drawing in which:

Figure 1:
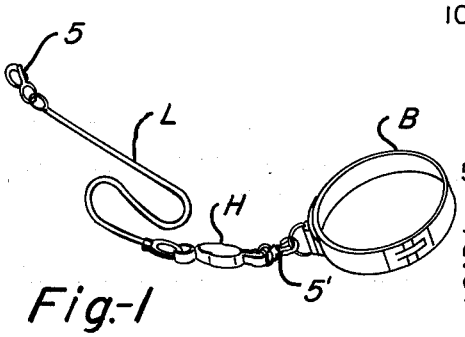
FIG. 1 is a small scale view of the shock absorber attached to a lanyard and to a safety belt in the manner in which it will be normally used.

Referring more particularly to the drawing, FIG. 1 depicts a typical arrangement of a shock absorber in a lanyard, safety-belt combination. A lanyard L, a rope of nylon, steel or like material has a snap S at one end for connection to an anchor loop or hook at the structure where the workman will be located. Such anchor loops are commonly provided for this purpose. The other end of the lanyard L is connected to the improved shock absorber A as hereinafter further described. The shock absorber A, in turn, carries a snap S' which connects to a D-ring D of a safety belt B to complete the assembly. Should a workman wearing the belt fall, the shock absorber A will release the web within it to decelerate and stop the fall as soon as the lanyard is pulled tightly.

Figure 2:
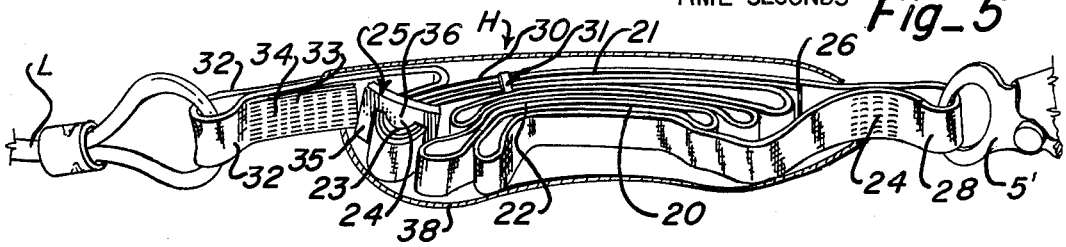
FIG. 2 is a perspective view of the shock absorber per se with the cover being partially removed to show the web arrangement therein.

FIG. 2 illustrates in further detail the construction of the shock absorber A. A single web 20 approximately 6-feet long is used and this web is folded and stitched to form a base section 21 and a free reach 22 in tandem. The base section 21 is about one-foot long and the free reach 22 about four feet long. Nylon is a preferable material for the web since it has considerable strength. For example, a lightweight nylon web one-inch wide can be obtained which has a strength of 6000 pounds, a strength sufficient for any contingency. Thus, the shock absorber A can be a compact package. Other fibers can also be used for the web, such as polyester and even cotton, although a shock absorber of these materials will be heavier in assembly and larger than a nylon web.

Figure 3:
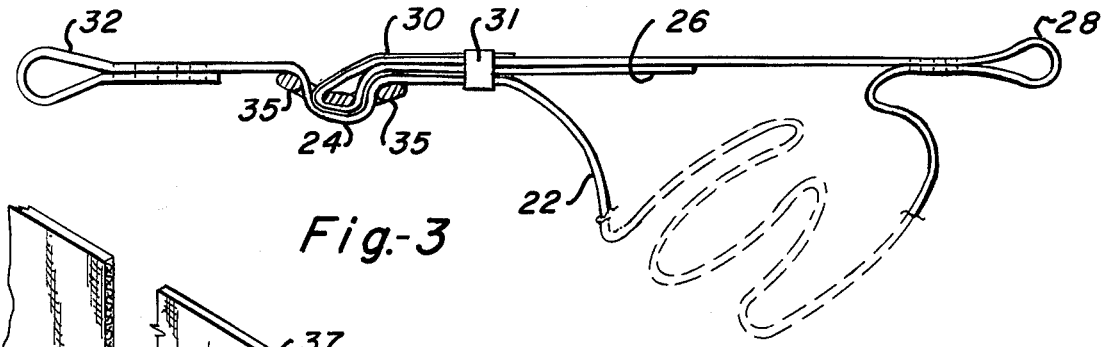
FiG. 3 is a diagrammatic plan view of the strap arrangement in the shock absorber, with the cover removed, with the three-bar slide in section and with broken lines showing the free reach of the web.
Figure 4:
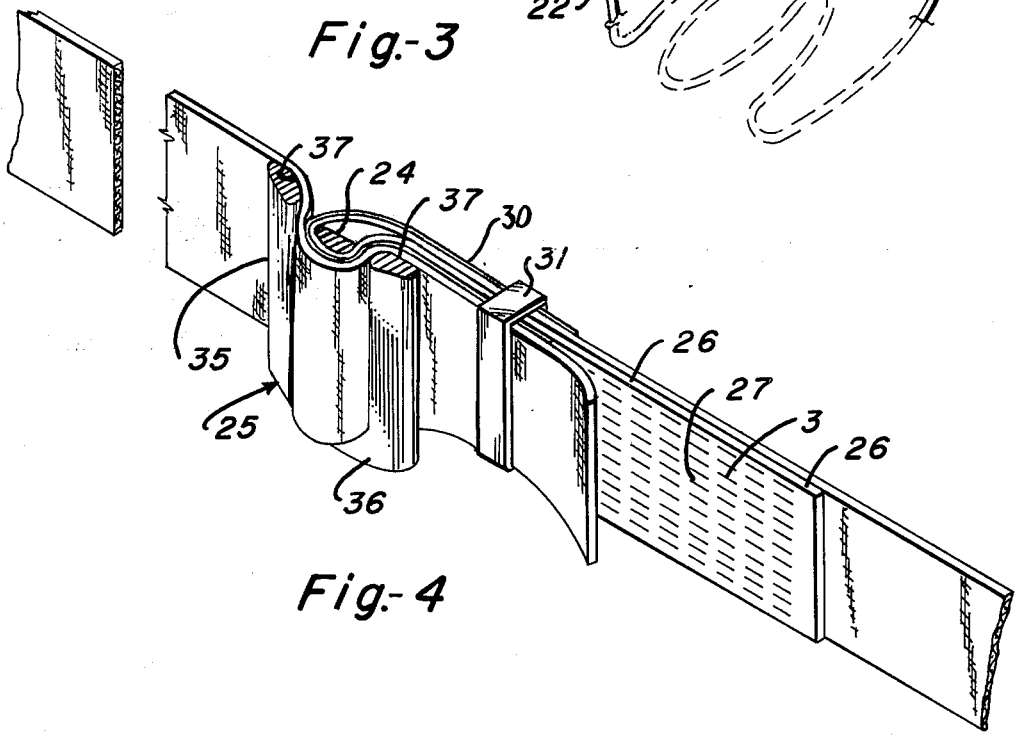
FIG. 4 is an isometric view of the web arrangement at the three-bar slide, similar to FIG. 2 but on an enlarged scale, and with the slide being in section.

The end of the base section 21 is overfolded to form a loop 23 which embraces the central bar 24 of a three-bar slide 25, with this free end 26 being stitched to the base section, as by stitching 27, as shown at FIG. 4. The opposite end of the base section, connecting with the free reach 22 is also formed as a loop 28 as by stitching 29, shown at FIG. 2. This loop 28 connects with the snap S' as a permanent connection. Another component of the base section 21 is a slide web 30 of cotton or similar material which overlies the loop 23 to also extend about the central bar 24 of the slide and this web slide 30 is held in place by the stitching 27. The slide web 30 functions to resist the heat generated by the movement of the free reach of the nylon web through the slide 25. The cotton can get so hot it will char without disruption but nylon on nylon, without the web, can actually melt the surface fibers of the loop 23. To complete the components forming the base section 21, a guide loop 31 is provided at the base section near the three-bar slide to guide the free reach 22 towards the slide as best shown at FIGS. 3 and 4.

The free reach 22, commencing at the stitching 29, has its free end threaded a short distance through the guide loop 31, thence about the central bar 24 of a three-bar slide 25 to extend therefrom and this free end is terminated as a loop 32 with the end 33 being stitched into place as by stitching 34. This loop 32 may connect with an end of the lanyard L as shown at FIG. 2 or in any other suitable manner.

The three-bar slide 25 includes the central bar 24 and side bars 35 paralleling the central bar with all three being held in position by ends 36, all in an arrangement similar to a common buckle. However, the proportions of this slide are such that the members are comparatively heavy since they will be subjected to considerable stress and will be required to pick up considerable heat when the unit is being used. The side bars 35 are offset from the central bar 24, as illustrated, to increase and enhance the distance over which the free reach 22 must move in order to pull this free reach through the buckle as illustrated at FIGS. 3 and 4. Accordingly, the ends 36 which hold these three slide bars in place are conveniently arched to position them in a proper manner and the edges of the slide bars are rounded as indicated at 37 where the web moves against them to minimize abusing the web.

To complete this unit the remainder of the free reach is folded back and forth across the base section 21 and the entire assembly is enclosed in a disruptible cover 38 as best illustrated at FIG. 2.

Figure 5:
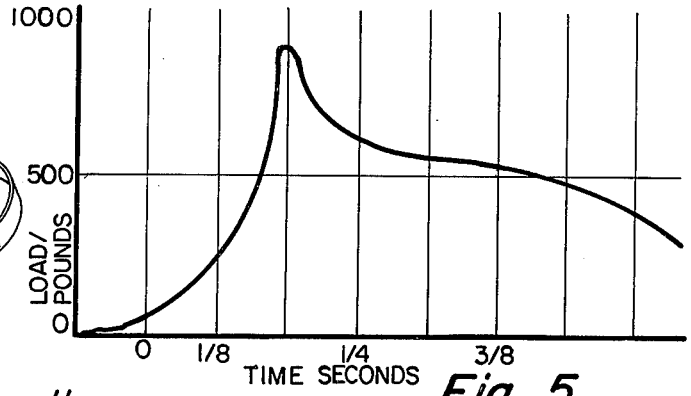
FIG. 5 is a load-time diagram exemplifying the performance of the shock absorber in decelerating a falling load comparable to the weight of a man.

In using the present invention, the shock absorber is properly attached to a lanyard and safety belt and whenever a fall is being checked, the tension between the connector loops 28 and 32 first ruptures the cover 38. Then the free reach 22 is pulled past the guide loop 31 and through the three-bar slide 25 with the combined pressure of the loop 23 and the side bars 35 against the free reach creating a substantial frictional drag, the magnitude of which is determined by the nature of the material and the size of the three-bar slide. A suitable drag force can be obtained by simple tests and can be varied by varying the spacing, the offset and the proportions of the bars 24 and 35 making up this slide. A discovery was that where these bars were made flat and parallel to provide an essentially perfect strip to the free reach, the drag force would be consistent and vary little in different shock absorber units. This is in contrast to pulling a web through an ordinary buckle where the force of the drag could not be predicted and would vary considerably. Not only were consistent results obtained, but also, a comparatively smooth, uniform frictional drag is possible with this unit. FIG. 5 shows an oscillograph of a test of such a unit. The resistance of the shock absorber when pulling commences registers a pull resistance of 900 pounds, for a small fraction of a second which quickly drops and levels off to a force of approximately 500 pounds as best shown at FIG. 3. The behavior of the unit is quite acceptable for a shock absorber. This curve indicates further that the force of resistance is practically uniform once the initial peak load is past, a very desirable result.

I have now described my invention in considerable detail. However, it is obvious that others skilled in the art can build and devise alternate and equivalent constructions which are nevertheless within the spirit and scope of my invention. Hence, I desire that my protection be limited not by the constructions illustrated and described, but only by the proper scope of the appended claims.

What is claimed is:

1. A web-type shock absorber for a safety belt-lanyard combination to decelerate to a stop the fall of a workman wearing the same, by pulling a selected length of a web through a resistance slide and comprising:

(a) a web of nylon or like material having a short base portion and a free reach in tandem, a first connector loop at the end of the base portion, a second connector loop between the base portion and the free reach and a third connector loop at the end of the free reach and wherein the length of the free reach corresponds to the aforesaid selected length to be pulled through a resistance slide;

(b) a resistance slide including a central bar and side bars in spaced parallelism proportioned to snugly receive the web with the said first loop being upon the central bar and with the end of the free reach adjacent to the said third loop being threaded upon the slide, about the said first loop between the adjacent side bars; and wherein said second loop and said third loop are connected to connector members of the safety belt-lanyard combination to be pulled by the combination in checking a fall with the free reach of the web moving through the resistance slide.

2. The combination defined in claim 1, including a guide loop affixed to the base portion adjacent to the slide bar through which the free reach is extended to facilitate guiding the free reach to and through the resistance slide.

3. The combination defined in claim 1, including a slide web extending about the said first loop to protect the first loop against the movement of the free reach as it is pulled through the resistance slide.

4. The combination defined in claim 3 wherein the web is woven nylon, the slide web is woven cotton fiber, said first, second and third loops are formed by stitching overlapping portions of the web and said slide web is secured to the stitching forming the said first loop.

5. The combination defined in claim 1 wherein the free reach is folded against the base portion to form a compact package and a disruptible cover encloses the package.

6. The combination defined in claim 1 wherein the resistance slide is formed with the central bar offset from the plane of the side bars whereby to increase the area of contact of the free reach wrapped about the said first loop and thereby enhance the frictional drag by the resistance slide.

* * * * *